US006136503A

United States Patent [19]

Zheng et al.

[11] Patent Number: 6,136,503

[45] **Date of Patent: *Oct. 24, 2000**

[54] IMAGING CYLINDER CONTAINING HEAT SENSITIVE THIOSULFATE POLYMER AND METHODS OF USE

[75] Inventors: Shiying Zheng, Rochester; Thap DoMinh, Webster, both of N.Y.

[73] Assignee: Eastman Kodak Company, Rochester, N.Y.

[ * ] Notice: This patent is subject to a terminal disclaimer.

[21] Appl. No.: 09/260,465

[22] Filed: Mar. 2, 1999

Related U.S. Application Data

[63] Continuation-in-part of application No. 09/156,833, Sep. 18, 1998, Pat. No. 5,985,514.

[51] Int. Cl.[7] ..... G03C 1/725

[52] U.S. Cl. ..... 430/270.1; 430/275.1; 430/944; 101/451; 101/467; 250/316.1

[58] Field of Search ..... 430/270.1, 275.1, 430/302, 944; 101/451, 456, 457, 467; 250/316, 317.1; 525/327.3, 330.4, 331.4, 403

[56] References Cited

U.S. PATENT DOCUMENTS

| | | | |
|---|---|---|---|
| 3,658,534 | 4/1972 | Ishitani et al. | 96/48 R |
| 4,081,572 | 3/1978 | Pacansky . | |
| 4,405,705 | 9/1983 | Etoh et al. . | |
| 4,634,659 | 1/1987 | Esumi et al. . | |
| 4,693,958 | 9/1987 | Schwartz et al. . | |
| 5,512,418 | 4/1996 | Ma . | |
| 5,587,446 | 12/1996 | Frechet et al. | 526/333 |
| 5,713,287 | 2/1998 | Gelbart . | |

FOREIGN PATENT DOCUMENTS

| | | |
|---|---|---|
| 0 293 058 | 5/1987 | European Pat. Off. . |
| 0 341 825 B1 | 11/1989 | European Pat. Off. . |
| 0 652 483 A1 | 6/1995 | European Pat. Off. . |
| 0 773 478 A1 | 5/1997 | European Pat. Off. . |
| 197671 | 7/1997 | Japan . |

OTHER PUBLICATIONS

Digital Printing 2000 The Missing Inventions, Dan Gelbart, 474–IS&T's 49$^{th}$ Annual Conference.

*Primary Examiner*—Janet Baxter
*Assistant Examiner*—Barbara Gilmore
*Attorney, Agent, or Firm*—J. Lanny Tucker

[57] ABSTRACT

An imaging member, such as a printing cylinder, is composed of a hydrophilic imaging layer formed from a heat-sensitive composition (for example, by spray coating) having a hydrophilic heat-sensitive polymer containing heat-activatable thiosulfate groups, and optionally a photothermal conversion material. Upon application of energy that generates heat, such as from IR irradiation, the polymer is crosslinked and rendered more hydrophobic. The exposed imaging member can be contacted with a lithographic printing ink and a fountain solution and used for printing with or without post-imaging wet processing. This imaging member is particularly useful for direct write imaging using IR lasers or thermal printing heads. In preferred embodiments, the imaging member is an on-press printing cylinder that is prepared, imaged and used on press.

21 Claims, No Drawings

IMAGING CYLINDER CONTAINING HEAT SENSITIVE THIOSULFATE POLYMER AND METHODS OF USE

This is a Continuation-in-part application of commonly assigned U.S. Ser. No. 09/156,833 filed Sep. 18, 1998 by Zheng and DoMinh, U.S. Pat. No. 5,985,514.

FIELD OF THE INVENTION

This invention relates in general to lithographic imaging members, and particularly to heat-sensitive imaging cylinders that can be used with or without wet processing after imaging. The invention also relates to a method of preparing and digitally imaging such imaging members, and to a method of printing using them.

BACKGROUND OF THE INVENTION

The art of lithographic printing is based upon the immiscibility of oil and water, wherein an oily material or ink is preferentially retained by an imaged area and the water or fountain solution is preferentially retained by the nonimaged areas. When a suitably prepared surface is moistened with water, and ink is then applied, the background or nonimaged areas retain the water and repel the ink while the imaged areas accept the ink and repel the water. The ink is eventually transferred to the surface of a suitable substrate, such as cloth, paper or metal, thereby reproducing the image.

Very common lithographic printing plates include a metal or polymer support having thereon an imaging layer sensitive to visible or UV light. Both positive- and negative-working printing plates can be prepared in this fashion. Upon exposure, and perhaps post-exposure heating, either imaged or nonimaged areas are removed using wet processing chemistries.

Thermally sensitive printing plates are less common. Examples of such plates are described in U.S. Pat. No. 5,372,915 (Haley et al). They include an imaging layer comprising a mixture of dissolvable polymers and an infrared radiation absorbing compound. While these plates can be imaged using lasers and digital information, they require wet processing using alkaline developer solutions.

It has been recognized that a lithographic printing plate could be created containing an IR absorbing layer. For example, Canadian 1,050,805 (Eames) discloses a dry planographic printing plate comprising an ink receptive substrate, an overlying silicone rubber layer, and an interposed layer comprised of laser energy absorbing particles (such as carbon particles) in a self-oxidizing binder (such as nitrocellulose). Such plates were exposed to focused near IR radiation with a $Nd^{++}$YAG laser. The absorbing layer converted the infrared energy to heat thus partially loosening, vaporizing or ablating the absorber layer and the overlying silicone rubber. The plate was developed by applying naphtha solvent to remove debris from the exposed image areas. Similar plates are described in *Research Disclosure* 19201, 1980 as having vacuum-evaporated metal layers to absorb laser radiation in order to facilitate the removal of a silicone rubber overcoated layer. These plates were developed by wetting with hexane and rubbing. $CO_2$ lasers are described for ablation of silicone layers by Nechiporenko & Markova, PrePrint 15th International IARIGAI Conference, June 1979, Lillehammer, Norway, Pira Abstract 02-79-02834. Typically, such printing plates require at least two layers on a support, one or more being formed of ablatable materials. Other ablation imaging processes are described for example in U.S. Pat. No. 5,385,092 (Lewis et al), U.S. Pat. No. 5,339,737 (Lewis et al), U.S. Pat. No. 5,353,705 (Lewis et al), U.S. Reissue Pat. No. 35,512 (Nowak et al) and U.S. Pat. No. 5,378,580 (Leenders).

While the noted printing plates used for digital, processless printing have a number of advantages over the more conventional photosensitive printing plates, there are a number of disadvantages with their use. The process of ablation creates debris and vaporized materials that must be collected. The laser power required for ablation can be considerably high, and the components of such printing plates may be expensive, difficult to coat, or unacceptable in resulting printing quality. Such plates generally require at least two coated layers on a support.

Thermally switchable polymers have been described for use as imaging materials in printing plates. By "switchable" is meant that the polymer is rendered from hydrophilic to relatively more hydrophobic, or from hydrophilic to relatively more hydrophobic, upon exposure to heat.

U.S. Pat. No. 4,634,659 (Esumi et al) describes imagewise irradiating hydrophobic polymer coatings to render exposed regions more hydrophilic in nature. While this concept was one of the early applications of converting surface characteristics in printing plates, it has the disadvantages of requiring long UV light exposure times (up to 60 minutes) and the plate's use is in a positive-working mode only.

In addition, EP-A 0 652 483 (Ellis et al) describes lithographic printing plates imageable using IR lasers, and which do not require wet processing. These plates comprise an imaging layer that becomes more hydrophilic upon the imagewise exposure to heat. This coating contains a polymer having pendant groups (such as t-alkyl carboxylates) that are capable of reacting under heat or acid to form more polar, hydrophilic groups. Imaging such compositions converts the imaged areas from hydrophobic to relatively more hydrophilic in nature, and thus requires imaging the background of the plate, which is generally a larger area. This can be a problem when imaging to the edge of the printing plate is desired.

Positive-working photoresists and printing plates having crosslinked, UV-sensitive polymers are described in EP-A 0 293 058 (Shirai et al). The polymers contain pendant iminosulfonate groups that are decomposed upon UV exposure, generating a sulfonic group and providing polymer solubility.

U.S. Pat. No. 5,512,418 (Ma) describes the use of polymers containing pendant ammonium groups for thermally induced imaging.

U.S. Pat. No. 4,693,958 (Schwartz et al) also describes a method of preparing printing plates that are wet processed. The imaging layers contain polyamic acids and vinyl polymers containing quaternary ammonium groups.

Japanese Kokai 9-197,671 describes a negative-working printing plate and imaging method in which the imaging layer includes a sulfonate-containing polymer, an IR radiation absorber, a novolak resin and a resole resin.

Thus, the graphic arts industry is seeking alternative means for providing a direct-write, negative-working lithographic printing plate that can be imaged without ablation and the accompanying problems noted above.

SUMMARY OF THE INVENTION

The problems noted above are overcome with an imaging cylinder comprising a cylindrical support having thereon a hydrophilic imaging layer comprising a hydrophilic heat-sensitive polymer comprising recurring units comprising a heat-activatable thiosulfate group, represented by structure I:

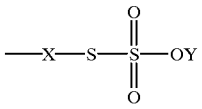

wherein X is a divalent linking group, and Y is hydrogen or a cation.

This invention also includes a method of imaging comprising the steps of:

A) providing the imaging member described above by spray coating a heat-sensitive composition containing the heat-sensitive polymer onto a support, and particularly onto a cylindrical support, and B) imagewise exposing the imaging member to provide exposed and unexposed areas in the imaging layer of the imaging member, whereby the exposed areas are crosslinked and rendered more hydrophobic than the unexposed areas by the heat generated by the imagewise exposing.

Preferably, the method is carried further with the step of:

C) contacting the imagewise exposed imaging member with a fountain solution and a lithographic printing ink, and imagewise transferring the printing ink from the imaging member to a receiving material.

The imaging member of this invention has a number of advantages, thereby avoiding the problems of known printing plates. Specifically, the problems and concerns associated with ablation imaging (that is, imagewise removal of surface layer) are avoided because imaging is accomplished by "switching" (preferably irreversibly) the exposed areas of its printing surface to be more hydrophobic, or oil-receptive by heat generated or provided during exposure to an appropriate energy source. The resulting imaging members display high ink receptivity in exposed areas and excellent ink/water discrimination. The imaging members also perform well with or without wet chemical processing after imaging to remove the unexposed areas. Preferably, no wet chemical processing (such as processing using an alkaline developer) is used in the practice of this invention. The imaging members are durable because the exposed areas are crosslinked during imaging. The printing members resulting from imaging the imaging members of this invention are generally negative-working.

These advantages are achieved by using a specific hydrophilic heat-sensitive polymer in the hydrophilic imaging layer. These polymers have heat-activatable thiosulfate groups (also known as Bunte salts) pendant to the polymer backbone that are believed to provide crosslinking sites upon exposure to heat. Such heat-activatable groups are described in more detail below.

The imaging members of this invention can be made easily by spray coating the heat-sensitive composition onto a suitable support. In a preferred embodiment, the support is a printing press cylinder or cylindrical sleeve, and the imaging member is prepared, imaged and used right on a printing press.

DETAILED DESCRIPTION OF THE INVENTION

The imaging members of this invention comprise a suitable support, and preferably a cylindrical support and one or more layers thereon that are heat-sensitive. The support can be any composed of any material including polymeric films, glass, metals or stiff papers, or a lamination of any of these materials having the appropriate thickness to sustain the wear from printing. By cylindrical supports is meant printing cylinders on press as well as printing sleeves that are fitted over a printing cylinder. The use of such members is described for example in U.S. Pat. No. 5,713,287 (Gelbart). For example, a heat-sensitive composition described herein can be applied in a suitable manner (for example, by coating or preferably by spraying) on the press support, and the composition is then dried and used for imaging in a suitable fashion as described herein.

The support may be coated with one or more "subbing" layers to improve adhesion of the final assemblage. Examples of subbing layer materials include, but are not limited to, gelatin and other naturally occurring and synthetic hydrophilic colloids and vinyl polymers (such as copolymers prepared from vinylidene chloride) known for such purposes in the photographic industry, vinylphosphonic acid polymers, alkoxysilanes, aminopropyltriethoxysilane, glycidoxypropyltriethoxysilane, sol-gel materials, epoxy functional polymers and ceramics.

The imaging member, however, preferably has only one layer, that is the heat-sensitive layer that is required for imaging. The hydrophilic imaging layer includes one or more heat-sensitive polymers, and optionally but preferably a photothermal conversion material (described below), and preferably provides the outer printing surface. Because of the particular heat-sensitive polymer(s) used in the imaging layer, the exposed (imaged) areas of the layer are crosslinked and rendered more hydrophobic in nature. The unexposed areas remain hydrophilic and can be washed off with a fountain solution on press, or developed in tap water after imaging.

In the heat-sensitive layer of the imaging members, only the heat-sensitive polymer and optionally the photothermal conversion material are necessary or essential for imaging.

Each of the heat-sensitive polymers useful in this invention has a molecular weight of at least 1000, and preferably of at least 5000. The polymers can be vinyl homopolymers or copolymers prepared from one or more ethylenically unsaturated polymerizable monomers that are reacted together using known polymerization techniques and reactants. Alternatively, they can be addition homopolymers or copolymers (such as polyethers) prepared from one or more heterocyclic monomers that are reacted together using known polymerization techniques and reactants. Additionally, they can be condensation type polymers (such as polyesters, polyimides, polyamides or polyurethanes) prepared using known polymerization techniques and reactants. Whatever the type of polymers, at least 10 mol % of the total recurring units in the polymer comprise the necessary heat-activatable thiosulfate groups.

The heat-sensitive polymers useful in the practice of this invention can be represented by the structure II wherein the thiosulfate group (or Bunte salt) is a pendant group:

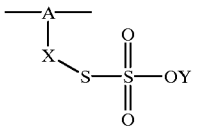

wherein A represents a polymeric backbone, X is a divalent linking group, and Y is hydrogen or a cation.

Useful polymeric backbones include, but are not limited to, vinyl polymers, polyethers, polyimides, polyamides, polyurethanes and polyesters. Preferably, the polymeric backbone is a vinyl polymer or polyether.

Useful "X" linking groups include —$(COO)_n(Z)_m$— wherein n is 0 or 1, m is 0 or 1, and Z is a substituted or unsubstituted alkylene group having 1 to 6 carbon atoms (such as methylene, ethylene, n-propylene, isopropylene, butylenes, 2-hydroxypropylene and 2-hydroxy-4-azahexylene) that can have one or more oxygen, nitrogen or sulfur atoms in the chain, a substituted or unsubstituted arylene group having 6 to 14 carbon atoms in the aromatic ring (such as phenylene, naphthalene, anthracylene and xylylene), or a substituted or unsubstituted arylenealkylene (or alkylenearylene) group having 7 to 20 carbon atoms in the chain (such as p-methylenephenylene, phenylenemethylenephenylene, biphenylene and phenyleneisopropylenephenylene). In addition, X can be an alkylene group, an arylene group, in an arylenealkylene group as defined above for Z.

Preferably, X is an alkylene group of 1 to 3 carbon atoms, an arylene group of 6 carbon atoms in the aromatic ring, an arylenealkylene group of 7 or 8 carbon atoms in the chain, or —$COO(Z)_m$— wherein Z is methylene, ethylene or phenylene. Most preferably, X is phenylene, methylene or —COO—.

Y is hydrogen, ammonium ion, or a metal ion (such as sodium, potassium, magnesium, calcium, cesium, barium, zinc or lithium ion). Preferably, Y is hydrogen, sodium ion or potassium ion.

As the thiosulfate group is generally pendant to the backbone, preferably it is part of an ethylenically unsaturated polymerizable monomer that can be polymerized using conventional techniques to form vinyl homopolymers of the thiosulfate-containing recurring units, or vinyl copolymers when copolymerized with one or more additional ethylenically unsaturated polymerizable monomers. The thiosulfate-containing recurring units generally comprise at least 10 mol % of all recurring units in the polymer, preferably they comprise from about 15 to 100 mol % of all recurring units, and more preferably, they comprise from about 15 to about 50 mol % of all recurring units. A polymer can include more than one type of repeating unit containing a thiosulfate group as described herein.

Polymers having the above-described thiosulfate group are believed to crosslink and to switch from hydrophilic thiosulfate to hydrophobic disulfide acid (upon loss of sulfate) with heating and water. Hence, the imaging member is a negative-working imaging member.

Thiosulfate-containing molecules (or Bunte salts) can be prepared from the reaction between an alkyl halide and thiosulfate salt as taught by Bunte, *Chem.Ber.* 7, 646, 1884. Polymers containing thiosulfate groups can either be prepared from functional monomers or from preformed polymers. If the polymer is a vinyl polymer, the functional vinyl polymerizable monomer can be prepared as illustrated below:

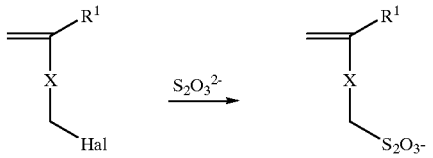

wherein $R_1$ is hydrogen or an alkyl group, Hal is halide, and X is a divalent linking group.

Polymers can also be prepared from preformed polymers in a similar manner as described in U.S. Pat. No. 3,706,706 (Vandengerg):

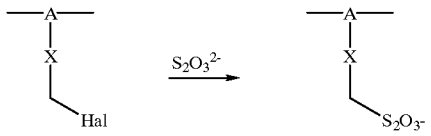

Thiosulfate-containing molecules can also be prepared by reaction of an alkyl epoxide with a thiosulfate salt, or between an alkyl epoxide and a molecular containing a thiosulfate moiety (such as 2-aminoethanethiosulfuric acid), and the reaction can be performed either on a monomer or polymer as illustrated by Thames, *Surf Coating,* 3 (Waterborne Coat.), Chapter 3, pp. 125–153, Wilson et al (Eds.):

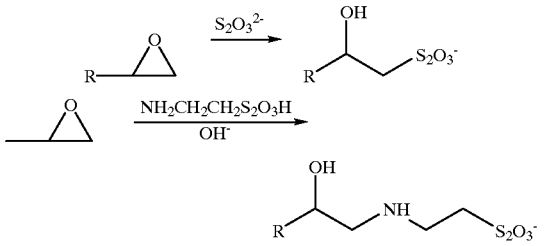

Representative synthetic methods for making ethylenically unsaturated polymerizable monomers and polymers useful in the practice of this invention are illustrated as follows.

SYNTHESIS EXAMPLE 1

Synthesis of poly[vinyl benzyl thiosulfate sodium salt -co-N-(3-aminopropyl)methacrylamide hydrochloride] From Monomer: Polymer 9

Vinyl benzyl chloride (20 g, 0.131 mol) was dissolved in 50 ml of ethanol in a 250 ml round-bottomed flask and placed in a 30° C. water bath. Sodium thiosulfate (18.8 g, 0.119 mol) was dissolved in 60 ml of 2:1 ethanol:water mixture, added to an addition funnel, and dripped into vinyl benzyl chloride solution over a period of 60 minutes. The reaction was stirred warm for additional 2 hours. Solvent was then evaporated and the white solid was dissolved in hot ethanol and hot filtered. White crystalline product was formed in the filtrate.

The resulting monomer (2 g, 8 mmol), 3-aminopropyl methacrylamide hydrochloride (0.16 g, 0.8 mmol), and 4,4'-azobis(4-cyanovaleric acid) (75% in water, 30 mg) were added to a 25 ml round-bottomed flask. The solution was purged with dry nitrogen for 15 minutes and then heated at 60° C. overnight. After cooling to room temperature, the solution was dialyzed against water overnight. The resulting polymer was subject to characterization and imaging testing.

SYNTHESIS EXAMPLE 2

Synthesis of poly(vinyl benzyl thiosulfate sodium salt) From Polymer: Polymer 7

Vinyl benzyl chloride (21.5 g, 0.141 mol) and azobisisobutylronitrile (hereafter referred to as "AIBN") (0.25 g, 1.5 mmol) were dissolved in 50 ml of toluene. The solution was purged with dry nitrogen and then heated at 65° C. overnight. After cooling to room temperature, the solution was diluted to 100 ml and added dropwise to 1000 ml of isopropanol. The white powdery polymer was collected by filtration and dried under vacuum at 40° C. overnight.

This polymer (10 g) was dissolved in 150 ml of N,N'-dimethylformamide. To this solution was added sodium thiosulfate (10.44 g, 0.066 mol) and 30 ml of water. Some polymer precipitated out. The cloudy reaction mixture was heated at 95° C. for 12 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated the reaction conversion was 99 mol %.

SYNTHESIS EXAMPLE 3

Synthesis of poly(chloromethyl-ethylene oxide-co-sodium thiosulfate methyl-ethylene oxide) From Polymer: Polymers 1–3

Poly(epichlorohydrin) (Aldrich Chemical Company, $M_n$=700,000) (10 g) was dissolved in 250 ml of anhydrous dimethylsulfoxide (DMSO) and anhydrous sodium thiosulfate (17.0 g) was added. The mixture was heated at 65° C. for 24 hours. After cooling to room temperature, the hazy reaction mixture was dialyzed against water. A small amount of the resulting polymer (Polymer 2) solution was freeze dried for elemental analysis and the rest of the polymer solution was subject to imaging testing. Elemental analysis indicated the reaction conversion to sodium thiosulfate was 16 mol %.

In another reaction of the same scale, the reaction mixture was heated at 85° C. for 40 hours. Elemental analysis of the resulting polymer (Polymer 3) indicated the conversion to sodium thiosulfate was 26 mol %. When the reaction was carried out at 65° C. for 18 hours, the conversion to sodium thiosulfate was 13 mol % (Polymer 1).

SYNTHESIS EXAMPLE 4

Synthesis of Polymers 4–6 and 8: Synthesis of poly (vinyl benzyl thiosulfate sodium salt-co-methyl methacylate) From Polymer: Polymer 5

Vinyl benzyl chloride (10 g, 0.066 mol), methyl methacrylate (15.35 g, 0.153 mol) and AIBN (0.72 g, 4 mmol) were dissolved 120 ml of toluene. The solution was purged with dry nitrogen and then heated at 65° C. overnight. After cooling to room temperature, the solution was dropwise added to 1200 ml of isopropanol. The resulting white powdery polymer was collected by filtration and dried under vacuum at 60° C. overnight. $^1$H NMR analysis indicate that the copolymer contained 44 mol % of vinyl benzyl chloride.

This polymer (16 g) was dissolved in 110 m of N,N'-dimethylformamide. To this solution was added sodium thiosulfate (12 g) and water (20 ml). Some polymer precipitated out. The cloudy reaction mixture was heated at 90° C. for 24 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated that all the vinyl benzyl chloride was converted to sodium thiosulfate salt.

Polymers 4, 6 and 8 were similarly prepared.

SYNTHESIS EXAMPLE 5

Synthesis of poly(2-sodium thiosulfate-ethyl methacrylate): Polymer 13

2-Chloroethyl methacrylate (10 g, 0.067 mol) and AIBN (0.11 g, 0.7 mmol) were dissolved in 20 ml of tetrahydrofuran. The solution was purged with dry nitrogen and then heated at 60° C. for 17 hours. After cooling to room temperature, the solution was diluted to 80 ml and added dropwise to 800 ml of methanol. The resulting white powdery polymer was collected by filtration and dried under vacuum at 40° C. overnight.

The above polymer (5 g) was dissolved in 50 ml of N,N'-dimethylformamide. To this solution was added sodium thiosulfate (5.3 g) and water (10 ml). Some polymer precipitated out. The cloudy reaction mixture was heated at 90° C. for 52 hours. After cooling to room temperature, the reaction mixture was dialyzed against water. A small amount of the resulting polymer solution was freeze dried for elemental analysis and the rest of the polymer solution was subject to imaging testing. Elemental analysis indicated that the conversion to sodium thisosulfate was 90 mol %.

SYNTHESIS EXAMPLE 6

Synthesis of Polymers 10–12: Synthesis of poly(2-hydroxy-3-sodium thiosulfate-propyl methacrylate-co-2-(methacryloyloxy)ethyl acetoacetate) From Polymer: Polymer 12

Glycidyl methacrylate (20.8 g, 0.146 mol), (methacryloyloxy)ethyl acetoacetate (2.72 g, 0.013 mol), and AIBN (0.52 g) were dissolved in 110 ml of N,N'-dimethylformamide in a 250 ml round-bottomed flask capped with a rubber septum. The solution was purged with dry nitrogen for 15 minutes and then heated at 60° C. for 15 hours. The product was diluted with 20 ml of N,N'-dimethylformamide and purified by precipitated into 1200 ml of isopropanol. The resulting white powdery polymer was filtered and dried under vacuum at 40° C. overnight.

The above polymer (10 g) was dissolved in 150 ml of N,N'-dimethylformamide. To this solution was added sodium thiosulfate (11 g) and water (30 ml). Some polymer precipitated out. The cloudy reaction mixture was heated at 65° C. for 24 hours. After cooling to room temperature, the hazy reaction mixture was dialyzed against water. Small amount of the resulting polymer solution was freeze-dried for elemental analysis and the rest of the polymer solution was subject to imaging testing. Elemental analysis indicated complete conversion of glycidyl methacrylate to sodium thiosulfate salt.

Polymer 10 and 11 were similarly prepared.

SYNTHESIS EXAMPLE 7

Synthesis of poly(4-aza-2-hydroxy-6-sodium thiosulfate-hexyl methacrylate) From Monomer: Polymer 14

Sodium hydroxide (4.5 g 0.112 mol) and 2-aminoethanethio-sulfuric acid (8.85 g, 0.056 mol) were dissolved in 15 ml of water in a 100 ml round-bottomed flask and cooled in an ice bath. Glycidyl methacrylate (8 g, 0.056 mol) was dissolved in 15 ml of tetrahydrofuran and added slowly to the above solution, keeping the temperature below 25° C. The reaction was followed by thin layer chromatography. After the completion of the reaction, 4,4'-azobis(4-cyanovaleric acid) (75% in water, 0.52 g, 1.4 mmol) was added to the reaction flask. The flask was capped with a septum, purged with dry nitrogen for 15 minutes, and then heated at 60° C. for 17 hours. After cooling to room temperature, the solution was dialyzed against water overnight. The resulting polymer was subject to characterization and imaging testing.

Vinyl polymers can be prepared by copolymerizing monomers containing the thiosulfate functional groups with one or more other ethylenically unsaturated polymerizable monomers to modify polymer chemical or functional properties, to optimize imaging member performance, or to introduce additional crosslinking capability.

Useful additional ethylenically unsaturated polymerizable monomers include, but are not limited to, acrylates (including methacrylates) such as ethyl acrylate, n-butyl acrylate, methyl methacrylate and t-butyl methacrylate, acrylamides (including methacrylamides), an acrylonitrile (including methacrylonitrile), vinyl ethers, styrenes, vinyl acetate, dienes (such as ethylene, propylene, 1,3-butadiene and isobutylene), vinyl pyridine and vinylpyrrolidone. Acrylamides, acrylates and styrenes are preferred.

Polyesters, polyamides, polyimides, polyurethanes and polyethers are prepared from conventional starting materials and using known procedures and conditions.

A mixture of heat-sensitive polymers described herein can be used in the imaging layer of the imaging members, but preferably only a single polymer is used. The polymers can be crosslinked or uncrosslinked when used in the imaging layer. If crosslinked, the crosslinkable moiety is preferably provided from one or more of the additional ethylenically unsaturated polymerizable monomers when the polymers are vinyl polymers. The crosslinking cannot interfere with the heat activation of the thiosulfate group during imaging.

The imaging layer of the imaging member can include one or more of such homopolymers or copolymers, with or without minor (less than 20 weight % based on total layer dry weight) amounts of additional binder or polymeric materials that will not adversely affect its imaging properties. However, the imaging layer includes no additional materials that are needed for imaging, especially those materials conventionally required for wet processing with alkaline developer solutions (such as novolak or resole resins).

The amount of heat-sensitive polymer(s) used in the imaging layer is generally at least 0.1 g/m$^2$, and preferably from about 0.1 to about 10 g/m$^2$ (dry weight). This generally provides an average dry thickness of from about 0.1 to about 10 $\mu$m.

The imaging layer can also include one or more conventional surfactants for coatability or other properties, or dyes or colorants to allow visualization of the written image, or any other addenda commonly used in the lithographic art, as long as the concentrations are low enough so that they are inert with respect to imaging or printing properties.

The heat-sensitive composition in the imaging layer preferably includes one or more photothermal conversion materials to absorb appropriate energy from an appropriate source (such as a laser), which radiation is converted into heat. Thus, such materials convert photons into heat phonons. Preferably, the radiation absorbed is in the infrared and near-infrared regions of the electromagnetic spectrum. Such materials can be dyes, pigments, evaporated pigments, semiconductor materials, alloys, metals, metal oxides, metal sulfides or combinations thereof, or a dichroic stack of materials that absorb radiation by virtue of their refractive index and thickness. Borides, carbides, nitrides, carbonitrides, bronze-structured oxides and oxides structurally related to the bronze family but lacking the $WO_{2.9}$ component, are also useful. One particularly useful pigment is carbon of some form (for example, carbon black). The size of the pigment particles should not be more than the thickness of the layer. Preferably, the size of the particles will be half the thickness of the layer or less. Useful absorbing dyes for near infrared diode laser beams are described, for example, in U.S. Pat. No. 4,973,572 (DeBoer), incorporated herein by reference. Particular dyes of interest are "broad band" dyes, that is those that absorb over a wide band of the spectrum. Mixtures of pigments, dyes, or both, can also be used. Particularly useful infrared radiation absorbing dyes and pigments include those illustrated as follows:

IR Dye 1

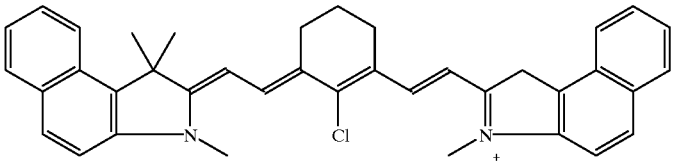

p-Toluenesulfonate

IR Dye 2

Same as IR Dye 1 but with $C_3F_7CO_2^-$ as the anion.

IR Dye 3

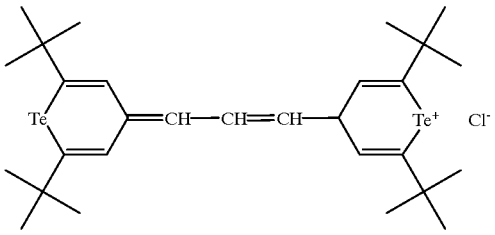

-continued

IR Dye 4

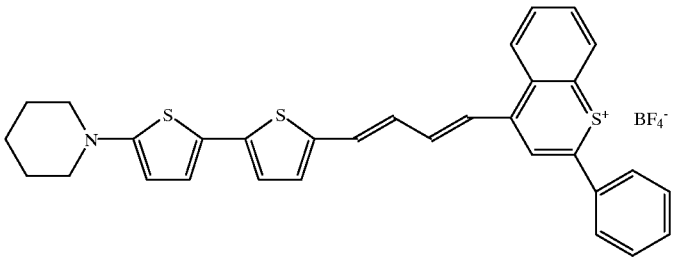

IR Dye 5

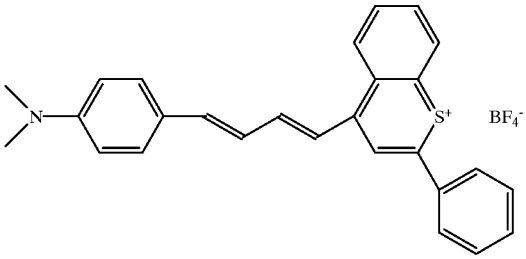

IR Dye 6

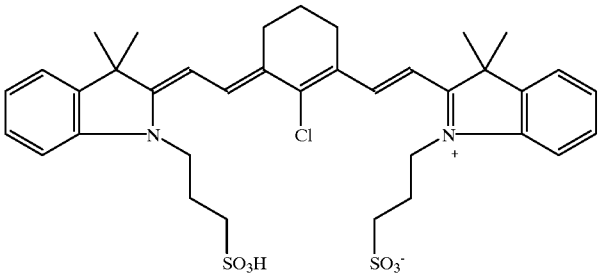

IR Dye 7

Same as IR Dye 1 but with chloride as the anion

The photothermal conversion material(s) are generally present in an amount sufficient to provide an optical density of at least 0.3, and preferably at least 1.0, at the operating wavelength of the imaging laser. The particular amount needed for this purpose would be readily apparent to one skilled in the art, depending upon the specific material used.

Alternatively, a photothermal conversion material can be included in a separate layer that is in contact with the heat-sensitive imaging layer. Thus, during imaging, the action of the photothermal conversion material can be transferred to the heat-sensitive polymer layer without the material originally being in the same layer.

The heat-sensitive composition can be applied to a member using any suitable equipment and procedure, such as spin coating, knife coating, gravure coating, dip coating or extrusion hopper coating. Preferably, it is sprayed onto the support using suitable spraying equipment. For example, a spray head useful for this purpose is described in U.S. Pat. No. 5,713,287 (noted above) and in a publication by Gelbart, *IS&T's* 49$^{th}$ *Annual Conference*, pages 474–476, 1996.

During use, the imaging member of this invention can be exposed to any suitable source of energy that generates or provides heat, such as a focused laser beam or thermoresistive head, in the imaged areas, typically from digital information supplied to the imaging device. A laser used to expose the imaging member of this invention is preferably a diode laser, because of the reliability and low maintenance of diode laser systems, but other lasers such as gas or solid state lasers may also be used. The combination of power, intensity and exposure time for laser imaging would be readily apparent to one skilled in the art. Specifications for lasers that emit in the near-IR region, and suitable imaging configurations and devices are described in U.S. Pat. No. 5,339,737 (Lewis et al), incorporated herein by reference. The imaging member is typically sensitized so as to maximize responsiveness at the emitting wavelength of the laser. For dye sensitization, the dye typically is chosen such that its $\lambda_{max}$ closely approximates the wavelength of laser operation.

The imaging apparatus can operate on its own, functioning solely as a platemaker, or it can be incorporated directly into a lithographic printing press. In the latter case, printing may commence immediately after imaging, thereby reducing press set-up time considerably. The imaging apparatus can be configured as a flatbed recorder or as a drum recorder, with the imaging member mounted to the interior or exterior cylindrical surface of the drum.

In the drum configuration, the requisite relative motion between the imaging device (such as a laser beam) and the imaging member can be achieved by rotating the drum (and the imaging member mounted thereon) about its axis, and moving the imaging device parallel to the rotation axis, thereby scanning the imaging member circumferentially so the image "grows" in the axial direction. Alternatively, the imaging device can be moved parallel to the drum axis and, after each pass across the imaging member, increment angularly so that the image "grows" circumferentially. In both cases, after a complete scan an image corresponding (positively or negatively) to the original document or picture can be applied to the surface of the imaging member.

In the flatbed configuration, a laser beam is drawn across either axis of the imaging member, and is indexed along the other axis after each pass. Obviously, the requisite relative motion can be produced by moving the imaging member rather than the laser beam.

While laser imaging is preferred in the practice of this invention, any other imaging means can be used that provides thermal energy in an imagewise fashion. For example, imaging can be accomplished using a thermoresistive head (or thermal printing head) in what is known as "thermal printing", as described for example, in U.S. Pat. No. 5,488,025 (Martin et al), incorporated herein by reference. Such thermal printing heads are commercially available (for example as Fujitsu Thermal Head FTP-040 MCS001 and TDK Thermal Head F415 HH7-1089).

Imaging of heat-sensitive compositions on printing press cylinders can be accomplished using any suitable means, for example, as taught in U.S. Pat. No. 5,713,287 (noted above), that is incorporated by reference.

After imaging, the imaging member (including an on-press sprayed cylinder) can be used for printing by applying a lithographic ink to the image on its printing surface, with a fountain solution, and by transferring the ink to a suitable receiving material (such as cloth, paper, metal, glass or plastic) to provide a desired impression of the image thereon. If desired, an intermediate "blanket" roller can be used in the transfer of the ink from the imaging member to the receiving material. The imaging members can be cleaned between impressions, if desired, using conventional cleaning means.

The following examples illustrate the practice of the invention, and are not meant to limit it in any way.

In these examples, a thermal IR-laser platesetter was used to image the printing plates, the printer being similar to that described in U.S. Pat. No. 5,168,288 (Baek et al), incorporated herein by reference. The printing plates were exposed using approximately 450 mW per channel, 9 channels per swath, 945 lines/cm, a drum circumference of 53 cm and an image spot (1/e2) at the image plane of about 25 $\mu$m. The test image included text, positive and negative lines, halftone dot patterns and a half-tone image. Images were printed at speeds up to 1100 revolutions per minute (the exposure levels do not necessarily correspond to the optimum exposure levels for the tested printing plates).

EXAMPLES 1–14

In these examples, imaging members of this invention comprising homopolymers and copolymers coated on polyester support were prepared and imaged on press.

Heat-sensitive imaging formulations were prepared from the following components:

| | |
|---|---|
| One of Polymer 1–14 (see below) | 0.20 g |
| IR dye 6 | 0.02 g |
| Water | 4.00 g |
| Methanol | 1.00 g |

-continued

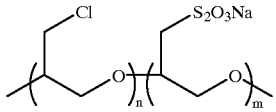

| | n | m |
|---|---|---|
| polymer 1 | 87 | 13 |
| polymer 2 | 84 | 16 |
| polymer 3 | 74 | 26 |

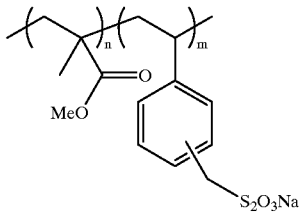

| | n | m |
|---|---|---|
| polymer 4 | 81 | 19 |
| polymer 5 | 70 | 30 |
| polymer 6 | 56 | 44 |
| polymer 7 | 0 | 100 |

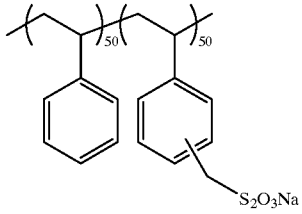

polymer 8

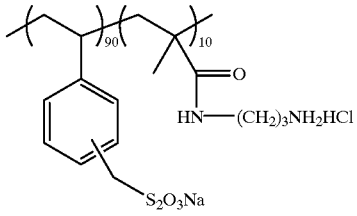

polymer 9

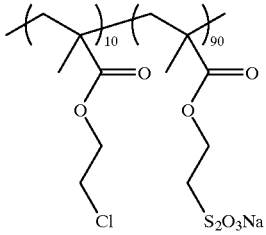

polymer 13

-continued

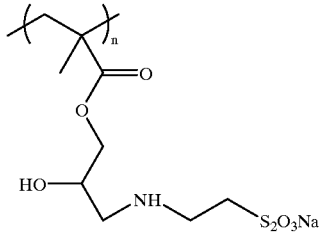

polymer 14

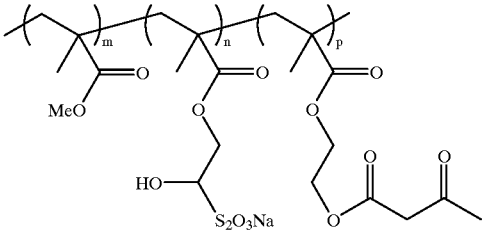

| | n | m | p |
|---|---|---|---|
| polymer 10 | 49 | 51 | 0 |
| polymer 11 | 64 | 36 | 0 |
| polymer 12 | 0 | 92 | 8 |

Each formulation containing 4.21 weight % of solids was coated at 100 mg/ft$^2$ (1.08 g/m$^2$) dry coverage onto a gelatin-subbed 0.10 mm poly(ethylene terephthalate) support. The resulting printing plates were dried in a convection oven at 82° C. for 3 minutes, clamped on the rotating drum of a conventional platesetter and digitally exposed to an 830 nm laser printhead at exposure levels ranging from 550 to 1350 mJ/cm$^2$. The resulting blue-green coatings rapidly discolored to a typically off-white color in the exposed regions.

A sample of each of the laser exposed printing plates was then mounted on the plate member of a full page commercially available A.B. Dick 9870 duplicator press for actual press runs using a commercially available black ink and Varn Universal Pink fountain solution (Varn Products Co.). The fountain solution simultaneously removed nonimaged areas of the printing surface. Each plate rolled up fast and acceptably printed with fill density the number of sheets noted in TABLE I below.

TABLE I

| Example | Polymer | Press Results (Printed Sheets) |
|---|---|---|
| 1 | 1 | 1,000 |
| 2 | 2 | 1,000 |
| 3 | 3 | 1,000 |
| 4 | 4 | 1,000 |
| 5 | 5 | 1,000 |
| 6 | 6 | 1,000 |
| 7 | 7 | 1,000 |
| 8 | 8 | 1,000 |
| 9 | 9 | 1,000 |
| 10 | 10 | 1,500 |
| 11 | 11 | 1,500 |
| 12 | 12 | 1,000 |
| 13 | 13 | 2,000 |
| 14 | 14 | 1,000 |

EXAMPLES 15–19

Imaging Members Coated on Aluminum Supports

Heat-sensitive coatings similar to those described in Examples 1–14 were prepared, coated onto 0.14 mm grained, anodized aluminum supports. After imaging as described in the previous examples, the printing plates were developed with tap water or several common "developing" solutions. Various methods of development and test results from printing are summarized in TABLE II, including one press run exceeding 40,000 impressions.

TABLE II

| Example | Polymer | Developing Solution | Press Results |
|---|---|---|---|
| 15 | 2 | KODAK MX-1587-1 Negative Plate Developer | 40,000 |
| 16 | 3 | Varn Universal Pink fountain solution (28 ml in 4 liters of water) | 1,500 |
| 17 | 7 | 2% Borax in water | 1,500 |
| 18 | 12 | Tap water | 1,500 |
| 19 | 9 | Tap water | 1,500 |

EXAMPLES 20–21

Use of Carbon Black in Heat-Sensitive Layers

These examples demonstrate the use of carbon black in the imaging members of this invention. Several heat-sensitive imaging formulations were prepared, coated on polyester film support and dried as described in Examples 1–14 above, except carbon black (0.02 g) instead of IR Dye 6 was used as the photothermal conversion material. Each resulting printing plate was imaged and tested on the printing press as described in Examples 1–14, and used to acceptably print at least 1000 sheets.

EXAMPLES 22–25

Imaging Members Having Aluminum Supports Useful for Direct-to-Press

These examples demonstrate that heat-sensitive compositions described here can be conveniently coated on appropriate substrates using various coating methods, including spraying, and used for direct-to-press applications.

Generally direct-to-press use requires coating a heat sensitive composition (either an aqueous or non-aqueous composition) using a coating method that is compatible with a printing press environment, including spraying, dipping or roller coating. The coating surfaces (that is, supports) can be in the form of cylinders or sleeves and are generally metallic (such as chrome or stainless steel). The resulting heat-sensitive layers exhibit adequate uniformity and dry quickly and are ready to be laser imaged in minutes. The energy requirement for imaging is ideally about 500 mJ/cm$^2$. The imaging members can be either processless (that is, no wet processing after imaging) or wet processable on press, and should be capable of some 15–50,000 impressions. After printing, the coating along with residual ink can be cleaned off and the printing surfaces can be reused.

The following heat-sensitive compositions ("5" and "15" containing Polymers 5 and 15, respectively) were prepared and used to prepare imaging members by spray coating. While these imaging members were in the form of printing plates, the same compositions and procedures could be readily adapted to prepare imaging members having cylindrical supports that could be coated and imaged on-press as described in U.S. Pat. No. 5,713,287 (noted above). The amounts of each component in the heat-sensitive compositions are in "parts by weight".

TABLE III

| COMPONENT | COMPOSITION "5" | COMPOSITION "15" |
|---|---|---|
| Heat-sensitiye Polymer 5 or 15* | 3.0 | 3.0 |
| IR Dye 6 | 0.6 | 0.6 |
| Methanol | 48.2 | 46.4 |
| Water | 48.2 | 50.0 |
| FC-430 surfactant** | 0.01 | 0.01 |

*Polymer 15 is a modification of Polymer 5 whereby 20 mol % of methyl methacrylate was replaced by N-methoxymethyl methacrylamide to provide crosslinkable moieties.
**FC430 is a fluorinated alkyl alkoxylate surfactant available from 3M Specialty Division.

Most of the compositions were spray coated using convenient commercial spray devices such as an artist air brush available from Paasche, or a Preval spray unit available from Valve Corp, of Yonkers, N.Y., at a distance of about 30–40 cm onto grained anodized aluminum. In one instance, a heat-sensitive coating was also prepared by simply spreading the composition ("gravity coating") on the aluminum support and uniformly distributing it by tilting the support sideways to drain off excess fluid by gravity. All coating thicknesses were in the range of 0.8 to 1.5 $\mu$m. Each coating was dried at 82° C. for 3 minutes, and imaged at 830 nm using a laser print head at energies ranging from 300 to 800 mJ/cm$^2$. Each resulting imaging member was put onto a commercial press (either an A.B. Dick 9870 duplicator using Varn Universal pink fountain solutions, or a Heidelberg GTO/DI press with Prisco Alkaless 3000 fountain solution). The fountain solutions acted initially also as on-press developers to remove non-imaged areas of the imaging members. Each imaging member rolled up within 20–25 sheets and printed with full density and clean background for at least 300–1000 sheets as shown on Table IV below. The inked images were also readily removed by rubbing with a commercially available negative or alkaline positive developer.

TABLE IV

| EXAMPLE | HEAT-SENSITIVE POLYMER | COATING METHOD | PRINTED IMPRESSIONS | PRINTING PRESS USED |
|---|---|---|---|---|
| 22 | 5 | Air brush | 1000 | A. B. Dick 9870 |
| 23 | 15 | Air brush | 1000 | " |
| 24 | 5 | Spray bottle | 300 | Heidelberg GTO |
| 25 | 5 | Gravity coating | 300 | " |

The invention has been described in detail with particular reference to preferred embodiments thereof, but it will be understood that variations and modifications can be effected within the spirit and scope of the invention.

We claim:

1. An imaging cylinder comprising a cylindrical support having thereon a hydrophilic imaging layer comprising a hydrophilic heat-sensitive polymer comprising recurring units comprising a heat-activatable thiosulfate group represented by structure I:

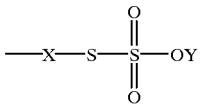

wherein X is a divalent linking group, and Y is a hydrogen or a cation.

2. The imaging cylinder of claim 1 wherein X is an alkylene group, an arylene group, an arylenealkylene group, or —$(COO)_n(Z)_m$ wherein n is 0 or 1, and Z is an alkylene group, an arylene group, or an arylenealkylene group, and Y is hydrogen, ammonium ion or a metal ion.

3. The imaging cylinder of claim 2 wherein X is an alkylene group of 1 to 3 carbon atoms, an arylene of 6 carbon atoms in the aromatic ring, an arylenealkylene of 7 or 8 carbon atoms in the chain, or —COOZ wherein Z is methylene, ethylene or phenylene, and Y is hydrogen, sodium or potassium.

4. The imaging cylinder of claim 3 wherein X is methylene, phenylene or —COO—.

5. The imaging cylinder of claim 1 wherein said imaging layer is the sole layer on said cylindrical support.

6. The imaging cylinder of claim 1 wherein said heat-sensitive polymer is a vinyl polymer, polyether, polyester, polyimide, polyamide or polyurethane having a molecular weight of at least 1000.

7. The imaging cylinder of claim 6 wherein said heat-sensitive polymer is a vinyl polymer or polyether.

8. The imaging cylinder of claim 7 wherein said heat-sensitive polymer is a vinyl copolymer or vinyl ether copolymer.

9. The imaging cylinder of claim 1 wherein said recurring units comprising said heat-activatable thiosulfate group comprise at least 10 mol % of all recurring units in said heat-sensitive polymer.

10. The imaging cylinder of claim 9 wherein said recurring units comprising said heat-activatable thiosulfate group comprise from 10 to about 100 mol % of all recurring units in said heat-sensitive polymer.

11. The imaging cylinder of claim 10 wherein said recurring units comprising said heat-activatable thiosulfate group comprise from about 15 to 50 mol % of all recurring units in said heat-sensitive polymer.

12. The imaging cylinder of claim 1 wherein said heat-sensitive polymer is a copolymer derived from two or more different ethylenically unsaturated polymerizable monomers, at least one of said monomers containing said heat-activatable thiosulfate group.

13. The imaging cylinder of claim 1 wherein said imaging layer further comprises a photothermal conversion material that is an infrared radiation absorbing material.

14. The imaging cylinder of claim 13 wherein said photothermal conversion material is carbon black or an IR radiation absorbing dye or pigment.

15. The imaging member of claim 1 having a metal cylindrical support.

16. The imaging member of claim 1 wherein said imaging cylinder is a printing cylinder on a printing press.

17. A method of imaging comprising the steps of:

A) providing an imaging member by spray coating onto a support, a heat-sensitive composition comprising a hydrophilic heat-sensitive polymer comprising recurring units comprising a heat-activatable thiosulfate group represented by structure I:

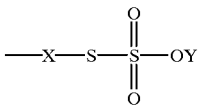

wherein X is a divalent linking group, and Y is a hydrogen or a cation, to form a heat-sensitive imaging layer on said support, and B) imagewise exposing said imaging member to provide exposed and unexposed areas in said imaging layer of said imaging member, whereby said exposed areas are crosslinked and rendered more hydrophobic than said unexposed areas by heat provided by said imagewise exposing.

18. The method of claim 17 wherein said imaging member further comprises a photothermal conversion material and said imagewise exposing is carried out using an IR radiation emitting laser.

19. The method of claim 17 wherein said imagewise exposing is carried out using a thermal printing head.

20. The method of claim 17 wherein said support is an on-press printing cylinder or sleeve.

21. The method of claim 17 further comprising the step of:

C) contacting said imagewise exposed imaging member with a fountain solution and a lithographic printing ink, and imagewise transferring said printing ink from said imaging member to a receiving material.

* * * * *